US006800041B2

(12) United States Patent
Fushihara

(10) Patent No.: US 6,800,041 B2
(45) Date of Patent: Oct. 5, 2004

(54) LIGHT WEIGHT GOLF BALL

(75) Inventor: Kazuhisa Fushihara, Kobe (JP)

(73) Assignee: Sumitomo Rubber Industries, Ltd., Kobe (JP)

( * ) Notice: Subject to any disclaimer, the term of this patent is extended or adjusted under 35 U.S.C. 154(b) by 0 days.

(21) Appl. No.: 09/932,984

(22) Filed: Aug. 21, 2001

(65) Prior Publication Data

US 2002/0045500 A1 Apr. 18, 2002

(30) Foreign Application Priority Data

Aug. 30, 2000 (JP) ..... 2000/260788

(51) Int. Cl.[7] ..... A63B 37/06
(52) U.S. Cl. ..... 473/377; 473/352
(58) Field of Search ..... 473/351, 352, 473/377

(56) References Cited

U.S. PATENT DOCUMENTS 4,085,937 A * 4/1978 Schenk ..... 473/352
5,439,227 A * 8/1995 Egashira et al. ..... 473/373
5,562,287 A * 10/1996 Endo et al. ..... 273/377
5,695,413 A * 12/1997 Yamagishi et al. ..... 473/374
5,702,311 A 12/1997 Higuchi et al.
5,820,487 A 10/1998 Nakamura et al.
5,820,492 A 10/1998 Yamagishi et al.
5,842,936 A * 12/1998 Mast ..... 473/352
5,931,747 A * 8/1999 Mast ..... 473/352
6,045,461 A 4/2000 Yamagishi et al.

FOREIGN PATENT DOCUMENTS

JP 06-327791 * 11/1994 ..... A63B/37/00
JP A8238334 9/1996
JP A8238337 9/1996
JP A8299497 11/1996
JP A9262317 10/1997

* cited by examiner

*Primary Examiner*—Raeann Gorden
(74) *Attorney, Agent, or Firm*—Birch, Stewart, Kolasch & Birch, LLP

(57) ABSTRACT

The present invention provides a light weight golf ball having excellent flight performance and good shot feel. The present invention relates to a light weight golf ball comprising a core and a cover covering the core, wherein the cover has a flexural modulus (F) of 200 to 600 MPa, the golf ball has a specific gravity of not less than 0.50 and less than 1.00, and a deformation amount (D) of 3.1 to 5.0 mm when applying from an initial load of 98 N to a final load of 1275 N, and a ratio (F/D) of the flexural modulus of the cover (F) to the deformation amount of the golf ball (D) is within the range of more than 50 and not more than 125.

9 Claims, 1 Drawing Sheet

1 = COVER WITH FLEXURAL MODULUS (F),
(F) = 300 TO 500 MPa
2 = CORE
GOLF BALL (CORE + COVER) HAVE:
(a) SPECIFIC GRAVITY = 0.5–1.00, AND
(b) DEFORMATION (D) = 4.1–5.5
(INITIAL LOAD 98N TO FINAL LOAD 1275 N).
(c) RATIO (F/D) ≤ 125>50.

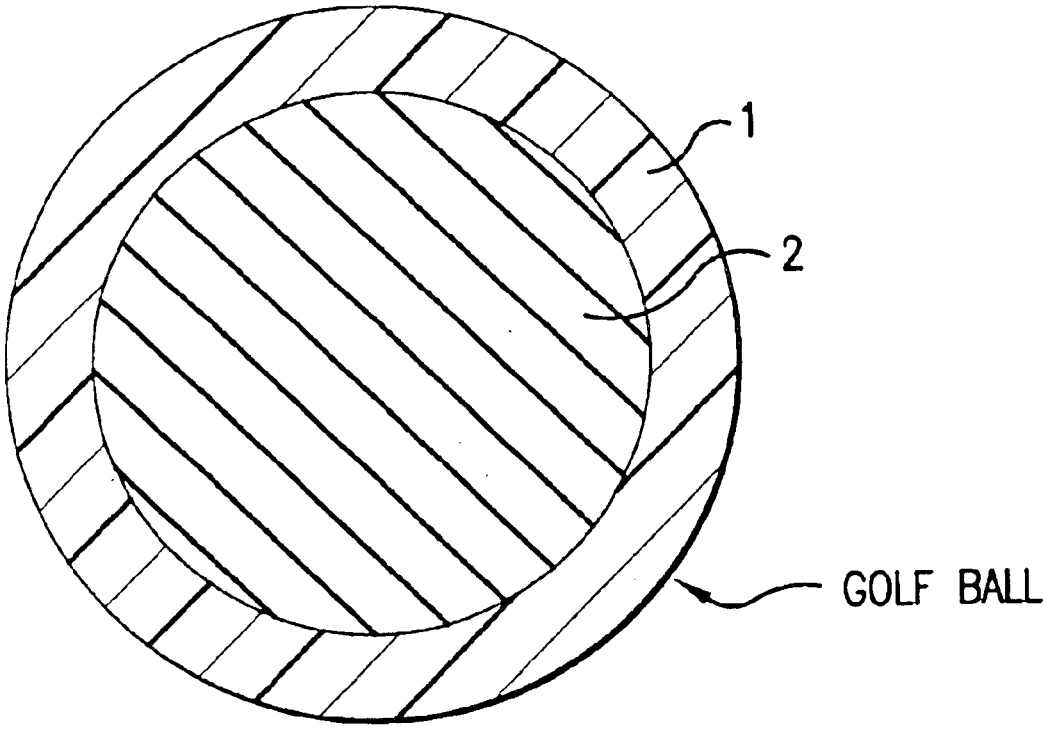
1 = COVER WITH FLEXURAL MODULUS (F),
(F) = 300 TO 500 MPa
2 = CORE
GOLF BALL (CORE + COVER) HAVE:
(a) SPECIFIC GRAVITY = 0.5–1.00, AND
(b) DEFORMATION (D) = 4.1–5.5
(INITIAL LOAD 98N TO FINAL LOAD 1275 N).
(c) RATIO (F/D) ≤ 125>50.

LIGHT WEIGHT GOLF BALL

FIELD OF THE INVENTION

The present invention relates to a light weight golf ball. More particularly, it relates to a light weight golf ball having excellent flight performance and good shot feel.

BACKGROUND OF THE INVENTION

It is generally considered that golf balls have longer flight distance with increasing a weight thereof, and the upper limit value of the weight is only established in accordance with regulations for golf balls. However, since golf balls having large weight tend to have poor shot feel, there has been an attempt of softening the golf balls. On the other hand, golf balls having small weight, which have short flight distance, but have excellent shot feel, have been known as "a light weight golf ball".

In a case of golf balls used at driving ranges for practicing golf, in which golf balls are hit facing a water surface of a lake, since it is further required for the golf balls to float on water in order to easily collect the golf balls after hitting, it is a necessary condition for the golf balls to have a specific gravity of less than 1.0. The golf ball is an example of particularly light golf ball in the light weight golf balls. The light weight golf balls are typically classified into a one-piece golf ball consisting of Integrally molded rubber material, and a two-piece golf ball consisting of a solid core of rubber material as a main component and a cover covering on the solid core, in the same manner as typical solid golf balls. The one-piece golf ball is frequently used at driving ranges, because it has excellent durability. The two-piece golf ball is frequently used as a golf ball for a round game, since it has excellent rebound characteristics. The light weight golf ball as a golf ball for a round game has been generally approved of or employed by non-muscular players, such as feminine players, junior players and the like, in order to accomplish good shot feel and low impact force.

Present one-piece golf balls mainly used at driving ranges have excellent durability, and have large deformation amount (compression) at the time of hitting in order to accomplish soft and good shot feel. However, since the golf balls have large deformation amount at the time of hitting, it is problem that the shot feel is heavy and poor.

Recently, it has been required also for the golf balls for driving ranges to have excellent performance nearly as good as golf balls for round games. Therefore so-called two-piece golf ball, which is formed by covering a cover, has been employed as a golf ball using at driving ranges for practicing golf, in which golf balls are hit facing water surface. A two-piece golf ball for the driving ranges, which has low specific gravity and floats on water, and has good shot feel nearly as good as golf balls for round games, is proposed (Japanese Patent Kokai Publication No. 327791/1994 and the like).

However, in the conventional light weight golf balls, since the flight distance is largely reduced by decreasing a weight of the golf ball, the weight is adjusted to not less than 40 g. Therefore the golf balls are yet heavy, and shot feel is not sufficiently obtained for non-muscular players, such as feminine players, junior players and the like.

OBJECTS OF THE INVENTION

A main object of the present invention is to provide a light weight golf ball having excellent flight performance and good shot feel.

According to the present invention, the object described above has been accomplished in a two-piece golf ball comprising a core and cover by adjusting a flexural modulus of the cover, a specific gravity of the golf ball, a deformation amount of the golf ball when applying from an initial load of 98 N to a final load of 1275 N and a ratio (F/D) of the flexural modulus of the cover (F) to the deformation amount of the golf ball (D) to specific ranges, thereby providing a light weight golf ball having excellent flight performance and good shot feel.

SUMMARY OF THE INVENTION

The present invention provides a light weight golf ball comprising a core and a cover covering the core, wherein the cover has a flexural modulus (F) of 200 to 600 MPa, the golf ball has a specific gravity of not less than 0.50 and less than 1.00, and a deformation amount (D) of 3.1 to 5.0 mm when applying from an initial load of 98 N to a final load of 1275 N, and a ratio (F/D) of the flexural modulus of the cover (F) to the deformation amount of the golf ball (D) is within the range of more than 50 and not more than 125.

In the golf ball of the present invention, soft and good shot feel at the time of hitting by non-muscular players, such as feminine players, junior players and the like, is accomplished by adjusting a weight of the golf ball to less than that of a conventional light weight golf ball, and the reduction of the flight distance thereby is compensated by optimizing a flexural modulus of the cover, which represents a hardness thereof. Therefore a light weight golf ball having excellent flight performance and good shot feel is accomplished.

In the golf ball of the present invention, it is required for the golf ball to have a specific gravity of not less than 0.50 and less than 1.00, preferably 0.80 to 0.99, more preferably 0.90 to 0.98, by which the weight of the golf ball is determined. When the specific gravity is not less than 1.00, the weight of the golf ball is large, and the shot feel is heavy and poor. On the other hand, when the specific gravity is less than 0.50, the weight of the golf ball is small, which reduces the flight distance. In addition, the directional stability is degraded, and it is disadvantage to round play in strong wind.

In the golf ball of the present invention, it is required for the cover to have a flexural modulus of 200 to 600 MPa, preferably 300 to 500 MPa, more preferably 300 to 400 MPa. When the flexural modulus is lower than 200 MPa, sufficient flight distance is not obtained. On the other hand, when the flexural modulus is higher than 600 MPa, the cover is too hard, and shot feel is poor.

In the golf ball of the present invention, it is required for the golf ball to have a deformation amount (ball compression) of 3.1 to 5.0 mm when applying from an initial load of 98 N to a final load of 1275 N, and the deformation amount is preferably 3.3 to 4.5 mm, more preferably 3.4 to 4.0 mm. When the deformation amount is smaller than 3.1 mm, the golf ball is too hard, and the shot feel is poor. On the other hand, when the deformation amount is larger than 5.0 mm, the golf ball is too soft, and the shot feel is poor. In addition, the rebound characteristics are degraded, and sufficient flight distance is not obtained.

In the golf ball of the present invention, a ratio (F/D) of the flexural modulus of the cover F (MPa) to the deformation amount of the golf ball D (mm) when applying from an initial load of 98 N to a final load of 1275 N is noticed, and it is required for the golf ball to have the ratio (F/D) of more than 50 and not more than 125, preferably 55 to 120, more preferably 65 to 110, most preferably 80 to 95. When the ratio (F/D) is not more than 50, the golf ball is soft and flexural modulus of the cover is low, and sufficient rebound characteristics are not obtained, which reduces the flight distance. On the other hand, when the ratio (F/D) is more than 125, the golf ball is hard and the cover is hard, and the shot feel is poor.

BRIEF DESCRIPTION OF THE DRAWING

The figure illustrates the two-piece golf ball showing a cross section thereof having a cover (1) and a core (2).

DETAILED DESCRIPTION OF THE INVENTION

The light weight golf ball of the present invention will be explained hereinafter in detail. The golf ball of the present invention comprises a core and a cover covering the core. The core may have a single-layer structure or a multi-layer structure which has two or more layers, and the cover may also have a single-layer structure or a multi-layer structure which has two or more layers. The core used in the golf ball of the present invention is formed from a vulcanized molded article of a rubber composition. The rubber composition essentially comprises a base rubber, co-crosslinking agent, organic peroxide and filler.

The base rubber may be one, which has been conventionally used for cores of golf balls. Preferred is polybutadiene rubber containing a cis-1,4 bond of not less than 40%, preferably not less than 80%. The polybutadiene rubber used in the present invention may be polybutadiene rubber containing a syndyotactic-1,2-polybutadiene of 5 to 30% and a cis-1,4-polybutadiene of not less than 40%, which has high crystallinity and high melting point, in order to impart the resulting golf ball to a proper hardness, that is, proper compression without large amount of inorganic filler, which increase the specific gravity of the golf ball, and accomplish suitable shot feel and durability. Examples of the polybutadiene include "UBEPOL-VCR309 (trade name)" (composition: syndyotactic-1,2-polybutadiene of 9%, cis-1,4-polybutadiene of 89% and trans-1,4-polybutadiene of 2%), "UBEPOL-VCR412 (trade name)" (composition: syndyotactic-1,2-polybutadiene of 12%, cis-1,4-polybutadiene of 86% and trans-1,4-polybutadiene of 2%) and the like, which are commercially available from Ube Industries, Ltd.

The polybutadiene rubber may be optionally mixed with natural rubber, polyisoprene rubber, polychloroprene rubber, polybutyl rubber, styrene-butadiene rubber (SBR), ethylene-propylene-diene rubber (EPDM), acrylonitrile rubber and the like. If used, it is preferable to adjust the amount of the rubber other than the polybutadiene so that the amount of the polybutadiene is within the range of not less than 50 parts by weight, based on 100 parts by weight of the base rubber.

It is desired to mix liquid rubber with the base rubber in order to improve processability. The amount of the liquid rubber is from 1 to 40 parts by weight, preferably from 5 to 15 parts by weight, based on 100 parts by weight of the base rubber. When the amount of the liquid rubber is smaller than 1 parts by weight, technical effects accomplished by the presence of the liquid rubber are sufficiently obtained. On the other hand, when the amount of the liquid rubber is larger than 40 parts by weight, the rebound characteristics of the resulting golf ball are degraded. The liquid rubber is not limited as long as it is rubber such as to be liquid in an unvulcanized state and at room temperature, but liquid diene rubber, such as liquid butadiene rubber, liquid isoprene rubber, is particularly suitable. Examples of the liquid rubbers include liquid butadiene rubber, which are commercially available from Nippon Petrochemicals Co., Ltd. under the trade name of "B-3000"; liquid isoprene rubber, which are commercially available from Kuraray Co., Ltd. under the trade name of "Kuraprene LIR-30"; and the like.

Examples of the co-crosslinking agents include a combination of α,β-unsaturated carboxylic acid having. 3 to 8 carbon atoms (e.g. acrylic acid, methacrylic acid, etc.) 20 and a metal oxide such as zinc oxide, which are separately compounded and react with each other during mixing the rubber composition to form a metal salt of α,β-unsaturated carboxylic acid; a metal salt of α,β-unsaturated carboxylic acid, which is originally in the form thereof (e.g. zinc acrylate, zinc methacrylate, etc.); or mixtures thereof. The amount of the co-crosslinking agent, when using a metal salt of α,β-unsaturated carboxylic acid, is from 5 to 30 parts by weight, preferably from 5 to 20 parts by weight, based on 100 parts by weight of the base rubber. When the amount of the co-crosslinking agent is larger than 30 parts by weight, the specific gravity of the resulting golf ball is large, and the amount of low specific gravity filler is large, which degrades the durability. In addition the core is hard, and the shot feel is poor. On the other hand, when the amount of the co-crosslinking agent is smaller than 5 parts by weight, the rebound characteristics of the resulting golf ball are degraded. When using the combination of α,β-unsaturated carboxylic acid and metal oxide, the amount of the α,β-unsaturated carboxylic acid is from 3 to 20 parts by weight, preferably from 5 to 15 parts by weight, and the amount of the metal oxide is from 3 to 20 parts by weight, preferably from 5 to 15 parts by weight, based on 100 parts by weight of the base rubber.

Examples of the organic peroxides include, for example, dicumyl peroxide, 1,1-bis (t-butylperoxy)-3,3,5-trimethylcyclohexane, 2,5-dimethyl-2,5-di(t-butylperoxy) hexane, di-t-butyl peroxide and the like. The preferred organic peroxide is dicumyl peroxide. The amount of the organic peroxide is 0.1 to 5.0 parts by weight, preferably 0.5 to 3.0 parts by weight, based on 100 parts by weight of the base rubber. When the amount of the organic peroxide is smaller than 0.1 parts by weight, the core is too soft, and the rebound characteristics are degraded. On the other hand, when the amount of the organic peroxide is larger than 5.0 parts by weight, the core is too hard and brittle, and the durability is degraded, or the shot feel is poor.

The filler is not limited as long as it has been conventionally used for cores of golf balls, but includes inorganic filler such as zinc oxide, barium sulfate, calcium carbonate and the like. It is preferable to use fineparticle high molecular weight polyolefin powder or hollow particulate. The fineparticle high molecular weight polyolefin powder preferably has an average particle diameter of 10 to 50 μm, and examples thereof include "Mipelon XM-220" (trade name, average particle diameter: 20 μm, molecular weight: not less than 2 millions), which is commercially available from Mitsui Chemicals, Inc. and the like.

The hollow particulate may be formed from inorganic material such as glass, ceramics and the like, or organic material such as acrylonitrile-methacrylonitrile copolymer, vinylidene chloride-acrylonitrile copolymer and the like. Examples of the hollow particulate include a hollow particulate of soda-lime borosilicate glass, which is commercially available from Sumitomo 3M co., Ltd. under the trade name of "Glassbubbles" (such as "Glassbubbles B37/2000", "Glassbubbles B38/4000", "Glassbubbles B46/4000", "Glassbubbles S60/10000").; methacrylonitrile-acrylonitrile copolymer, which is commercially available from Chema Norval Co. under the trade name of "Expancel" (such as "Expancel 091DE", "Expancel 091DE80") and the like.

The amount of the filler is 1 to 30 parts by weight, preferable 5 to 20 parts by weight, based on 100 parts by weight of the base rubber. When the amount of the filler is smaller than 1 parts by weight, the technical effects of lightening the resulting golf ball are not sufficiently obtained. On the other hand, when the amount of the filler is larger than 30 parts by weight, the durability is easily degraded.

The rubber composition for the core of the golf ball of the present invention can contain high-styrene resin and the like in order to impart hardness to the resulting golf ball. The rubber composition can optionally contain other components, such as softening agent, liquid rubber or anti-oxidant.

The core used for the golf ball of the present invention can be obtained by mixing with a mixer such as a mixing roll, kneader and the like, and then press-molding the above rubber composition under applied heat of 130 to 170° C. for 10 to 30 minutes in a mold. In the golf ball of the present invention, it is desired for the core to have a diameter of 36.5 to 42.5 mm, preferably 36.7 to 40.8 mm. When the diameter of the core is smaller than 36.5 mm, the thickness of the cover is large, and the impact force at the time of hitting is large. In addition, the volume of the core is small, and the rebound characteristics are degraded. On the other hand, when the diameter of the core is larger than 42.5 mm, the thickness of the cover is small, and the durability is degraded.

In the golf ball of the present invention, the core has a deformation amount (core compression) when applying from an initial load of 98 N to a final load of 1275 N of 4.1 to 5.5 mm, preferably 4.2 to 5.2 mm, preferably 4.5 to 4.9 mm. When the deformation amount is smaller than 4.1 mm, shot feel of the resulting golf ball is hard and poor. On the other hand, when the deformation amount is larger than 5.5 mm, rebound characteristics are not sufficiently obtained.

The cover is then covered on the core. In the golf ball of the present invention, it is desired for the cover to have a thickness of 0.3 to 3.5 mm, preferably 1.0 to 3.0 mm. When the thickness is smaller than 0.3 mm, the durability of the cover is degraded. On the other hand, when the thickness is larger than 3.5 mm, the volume of the core is small or the deformation reached to the core at the time of hitting is small, the rebound characteristics are degraded.

The cover of the present invention is not limited as long as it has properties as described above, but contains thermoplastic resin, particularly ionomer resin, which has been conventionally used for the cover of golf balls, as a base resin. The ionomer resin may be a copolymer of ethylene and α,β-unsaturated carboxylic acid, of which at least a portion of carboxylic acid groups is neutralized with metal ion, or a terpolymer of ethylene, α,β-unsaturated carboxylic acid and α,β-unsaturated carboxylic acid ester, of which at least a portion of carboxylic acid groups is neutralized with metal ion. Examples of the α,β-unsaturated carboxylic acid in the ionomer include acrylic acid, methacrylic acid, fumaric acid, maleic acid, crotonic acid and the like, preferred are acrylic acid and methacrylic acid. Examples of the α,β-unsaturated carboxylic acid ester in the ionomer include methyl ester, ethyl ester, propyl ester, n-butyl ester and isobutyl ester of acrylic acid, methacrylic acid, fumaric acid, maleic acid and the like. Preferred are acrylic acid esters and methacrylic acid esters. The metal ion which neutralizes at least a portion of carboxylic acid groups of the copolymer or terpolymer includes a sodium ion, a potassium ion, a lithium ion, a magnesium ion, a calcium ion, a zinc ion, a barium ion, an aluminum, a tin ion, a zirconium ion, cadmium ion, and the like. Preferred are sodium ions, zinc ions, magnesium ions and the like, in view of rebound characteristics, durability and the like.

The ionomer resin is not limited, but examples thereof will be shown by a trade name thereof. Examples of the ionomer resins, which are commercially available from Mitsui Du Pont Polychemical Co., Ltd. include Hi-milan 1555, Hi-milan 1557, Hi-milan 1605, Hi-milan 1652, Hi-milan 1702, Hi-milan 1705, Hi-milan 1706, Hi-milan 1707, Hi-milan 1855, Hi-milan 1856, Hi-milan AM7316 and the like. Examples of the ionomer resins, which are commercially available from Du Pont Co., include Surlyn 8945, Surlyn 9945, Surlyn 6320, Surlyn 8320, Surlyn AD8511, Surlyn AD8512, Surlyn AD8542 and the like. Examples of the ionomer resins, which are commercially available from Exxon Chemical Co., include Iotek 7010, Iotek 8000 and the like. These ionomer resins may be used alone or in combination.

As the materials suitably used in the cover of the present invention, the above ionomer resin may be used alone, but the ionomer resin may be used in combination with at least one of thermoplastic elastomer, diene-based block copolymer and the like.

Examples of the thermoplastic elastomers include polyamide-based thermoplastic elastomer, which is commercially available from Toray Co., Ltd. under the trade name of "Pebax" (such as "Pebax 2533"); polyester-based thermoplastic elastomer, which is commercially available from Toray-Du Pont Co., Ltd. under the trade name of "Hytrel" (such as "Hytrel 3548", "Hytrel 4047"); polyurethane-based thermoplastic elastomer, which is commercially available from Takeda Badische Urethane Industries, Ltd. under the trade name of "Elastollan" (such as "Elastollan ET880"); and the like.

The diene-based block copolymer is a block copolymer or partially hydrogenated block copolymer having double bond derived from conjugated diene compound. The base bock copolymer is block copolymer composed of block polymer block A mainly comprising at least one aromatic vinyl compound and polymer block B mainly comprising at least one conjugated diene compound. The partially hydrogenated block copolymer is obtained by hydrogenating the block copolymer. Examples of the aromatic vinyl compounds comprising the block copolymer include styrene, α-methyl styrene, vinyl toluene, p-t-butyl styrene, 1,1-diphenyl styrene and the like, or mixtures thereof. Preferred is styrene. Examples of the conjugated diene compounds include butadiene, isoprene, 1,3-pentadiene, 2,3-dimethyl-1,3-butadiene and the like, or mixtures thereof. Preferred are butadiene, isoprene and combinations thereof. Examples of the diene block copolymers include an SBS (styrene-butadiene-styrene) block copolymer having polybutadiene block with epoxy groups or SIS (styrene-isoprene-styrene) block copolymer having polyisoprene block with epoxy groups and the like. Examples of the diene-based block copolymers, which are commercially available, include the diene block copolymers, which are commercially available from Daicel Chemical Industries, Ltd. under the trade name of "Epofriend" (such as "Epofriend A1010") and the like.

The amount of the thermoplastic elastomer or diene-based block copolymer is 1 to 60 parts by weight, preferably 1 to 35 parts by weight, based on 100 parts by weight of the base resin for the cover. When the amount is smaller than 1 parts by weight, the technical effects of absorbing the impact force at the time of hitting accomplished by using them are not sufficiently obtained. On the other hand, when the amount is larger than 60 parts by weight, the cover is too soft and the rebound characteristics are degraded, or the compatibility with the ionomer resin is degraded and the durability is degraded.

The composition for the cover used in the present invention may optionally contain pigments (such as titanium dioxide, etc.) and the other additives such as a dispersant, an antioxidant, a UV absorber, a photostabilizer and a fluorescent agent or a fluorescent brightener, etc., in addition to the resin component, as long as the addition of the additives does not deteriorate the desired performance of the golf ball cover.

A method of covering with the cover is not specifically limited, but may be a conventional method. For example, there can be used a method comprising molding the cover composition into a semi-spherical half-shell in advance, covering the core, which is covered with the intermediate layer, with the two half-shells, followed by pressure molding at 130 to 170° C. for 1 to 5 minutes, or a method comprising injection molding the cover composition directly on the core to cover it. At the time of molding the cover, many depressions called "dimples" may be optionally formed on the surface of the golf ball. Furthermore, paint finishing or marking with a stamp may be optionally provided after the cover molded for commercial purposes.

The weight of the golf ball is limited to the range of not more than 45.92 g in accordance with the regulations for large size golf balls, but the lower limit is not limited. The golf ball of the present invention has a weight of 35.0 to 41.0 g, preferably 38.0 to 40.5 g. When the weight of the golf ball is smaller than 35.0 g, the golf ball loses inertia on a flight, and stalls, which reduces the flight distance. On the other hand, when the weight of the golf ball is larger than 41.0 g, the shot feel is heavy and poor.

The diameter of the golf ball of the present invention is preferably formed to a diameter of 42.67 to 42.90 mm, in accordance with the regulations for large size golf balls, that is, a diameter of at least 42.67 mm.

EXAMPLES

The following Examples and Comparative Examples further illustrate the present invention in detail but are not to be construed to limit the scope of the present invention.

Production of the Core

The rubber composition for the core having the formulations shown in Table 1 was mixed, and the mixture was then press-molded at 155° C. for 16 minutes, and then 160° C. for 8 minutes in a mold, which is composed of an upper mold and a lower mold having a hemispherical cavity, to obtain a spherical core having a diameter of 38.5 mm. The compression of the resulting core was measured, and the results are shown in Table 3. The test method is described later.

TABLE 1

| | (parts by weight) | | | | |
|---|---|---|---|---|---|
| | Example No. | | Comparative Example No. | | |
| | 1 | 2 | 1 | 2 | 3 |
| BR11 *1 | 60 | 90 | 60 | 60 | 60 |
| VCR412 *2 | 40 | — | 40 | 40 | — |
| Mipelon XM-220 *3 | 30 | 20 | 30 | 15 | 15 |
| Nipol 2007J *4 | 13 | — | 13 | 13 | — |
| B3000 *5 | 15 | 10 | 15 | — | 10 |
| Zinc oxide | 10 | — | 10 | 12 | — |
| hollow particulate *6 | — | — | — | 20 | — |
| Zinc acrylate | — | 11 | — | — | 6 |
| Methacrylic acid | 10 | — | 10 | 12 | — |
| Zinc stearate | — | 1 | — | — | 1 |
| Dicumyl peroxide | 1.7 | 1.7 | 1.7 | 1.5 | 1.7 |

*1: Cis-1,4-polybutadiene rubber, which is commercially available from JSR Co., Ltd. under the trade name of "BR-11" (Content of 1,4-cis-polybutadiene: 96%)
*2: Polybutadiene rubber containing syndyotactic-1,2-polybutadiene of 12% by weight, cis-1,4-polybutadiene of 86% by weight and trans-1,4-polybutadiene of 2% by weight, which is commercially available from Ube Industries, Ltd. under the trade name of "UBEPOL-VCR412"
*3: Fineparticle ultrahigh molecular weight polyolefin powder, which is commercially available from Mitsui Chemicals, Inc. under the trade name of "Mipelon XM-220" (average particle diameter: 20 μm, molecular weight: not less than 2 millions)
*4: High-styrene resin, which is commercially available from Nippon Zeon Co., Ltd. under the trade name of "Nipol 2007J"
*5: Liquid polybutadiene rubber, which is commercially available from Nippon Petrochemicals Co., Ltd. under the trade name "B3000".
*6: Hollow particulate of soda-lime borosilicate glass having a pressure resistance of 69 MPa and an average particle density of 0.60 g/cc, which is commercially available from Sumitomo 3M, Ltd.

Preparation of Cover Compositions

The formulation materials showed in Table 2 were mixed using a kneading type twin-screw extruder to obtain pelletized cover compositions. The extrusion condition was, a screw diameter of 45 mm, a screw speed of 200 rpm, and a screw L/D of 35.

The formulation materials were heated at 150 to 260° C. at the die position of the extruder. The flexural modulus F (MPa) of the resulting cover composition was measured. The results are shown in Table 3. The test method is described later.

TABLE 2

| | (parts by weight) | | | | |
|---|---|---|---|---|---|
| | Example No. | | Comparative Example No. | | |
| Cover composition | 1 | 2 | 1 | 2 | 3 |
| Hi-milan 1605 *7 | 60 | 60 | — | — | 60 |
| Hi-milan 1705 *8 | — | — | 20 | 10 | — |
| Hi-milan 1706 *9 | 40 | 40 | 45 | 90 | 40 |
| Hi-milan 1855 *10 | — | — | 35 | — | — |
| Titanium dioxide | 1 | 1 | 1 | 1 | 1 |

*7: Hi-milan 1605 (trade name), ethylene-methacrylic acid copolymer ionomer resin obtained by neutralizing with sodium ion, manufactured by Mitsui Du Pont Polychemical Co., Ltd.
*8: Hi-milan 1705 (trade name), ethylene-methacrylic acid copolymer ionomer resin obtained by neutralizing with zinc ion, manufactured by Mitsui Du Pont Polychemical Co., Ltd.

TABLE 2-continued

| | (parts by weight) | | | | |
|---|---|---|---|---|---|
| | Example No. | | Comparative Example No. | | |
| Cover composition | 1 | 2 | 1 | 2 | 3 |

*9: Hi-milan 1706 (trade name), ethylene-methacrylic acid copolymer ionomer resin obtained by neutralizing with zinc ion, manufactured by Mitsui Du Pont Polychemical Co., Ltd.
*10: Hi-milan 1855 (trade name), ethylene-methacrylic acid-isobutyl acrylate terpolymer ionomer resin obtained by neutralizing with zinc ion, manufactured by Mitsui Du Pont Polychemical Co., Ltd.

EXAMPLES 1 TO 2 AND COMPARATIVE EXAMPLES 1 TO 3

The resulting cover compositions were covered on the core obtained as described above by injection molding to form the cover layer. Then, paint was applied on the surface to produce golf ball having a diameter of 42.7 mm. With respect to the resulting golf balls, the specific gravity, compression D (mm), flight distance and shot feel were measured or evaluated. A ratio (F/D) of the flexural modulus F (MPa) described above to the compression D (mm) was calculated, and the result is shown in Table 3. The test methods are as follows.

(Test method)

(1) Compression

The compression was determined by measuring the deformation amount (mm) when applying from an initial load of 98 N to a final load of 1275 N on the golf ball or core.

(2) Flexural modulus

The flexural modulus of a slab only consisting of the cover composition was determined according to ASTM D-790, using a sample of a heat and press molded sheet having a thickness of about 2 mm from the each cover composition, which had been stored at 23° C. for 2 weeks.

(3) Flight performance

After a No. 1 wood club (a driver, W#1) having metal head was mounted to a swing robot manufactured by True Temper Co. and a golf ball was hit such as to be a head speed of 40 m/sec, a launch angle of 11 degrees and a backspin amount of 3000 rpm by adjusting the machine condition, flight distance was measured. As the flight distance, total that is a distance to the stop point of the hit golf ball was measured. The measurement was conducted by using 10 golf balls for every sample (n=10), and the average was obtained. The result is indicated by an index when that of Example 1 is 100. The larger the index is, the longer the flight distance is.

(4) Shot feel

The shot feel of the golf ball is evaluated by all 10 golfers, which consist of 5 feminine golfers and 5 junior golfers, according to a practical hitting test using a No.1 wood club (a driver, W#1). The evaluation criteria are as follows. The results shown in the Tables below are based on the fact that the most golfers evaluated with the same criterion about shot feel.

(Evaluation criteria)

o: The golfers felt that the golf ball has small impact force, and good shot feel.

Δ: The golfers felt that the golf ball has fairly good shot feel.

x: The golfers felt that the golf ball has large impact force, and poor shot feel.

(Test result)

TABLE 3

| | Example No. | | Comparative Example No. | | |
|---|---|---|---|---|---|
| Test item | 1 | 2 | 1 | 2 | 3 |
| Core compression (mm) | 4.5 | 4.9 | 4.5 | 3.7 | 6.5 |
| Cover flexural modulus F (MPa) | 320 | 320 | 170 | 310 | 320 |
| Ball compression D (mm) | 3.5 | 3.7 | 3.8 | 3.0 | 5.2 |
| Ratio (F/D) | 91 | 86 | 45 | 103 | 62 |
| Ball specific gravity | 0.990 | 0.980 | 0.990 | 0.953 | 0.980 |
| Flight distance | 100 | 98 | 80 | 110 | 90 |
| Shot feel | o | o | o | x | o |

As is apparent from Table 3, the golf balls of the present invention of Examples 1 to 2 have good shot feel and excellent flight performance when compared with the conventional golf balls of Comparative Examples 1 to 3.

On the other hand, in the golf ball of Comparative Example 1, the ball compression is adjusted to a proper range, and the shot feel is good. However, since the flexural modulus of the cover is low and the ratio (F/D) is small, the flight distance is very short.

In the golf ball of Comparative Example 2, the flexural modulus of the cover is adjusted to a proper range, but the ball compression is small and the golf ball is too hard as a whole, and the shot feel is poor.

In the golf ball of Comparative Example 3, of which the cover has proper flexural modulus, since the ball compression is small, the shot feel is good, but the golf ball is too soft, and the flight distance is very short.

What is claimed is:

1. A light weight two-piece golf ball comprising a core and a cover covering the core, wherein the cover has a flexural modulus (F) of 300 to 500 MPa,.

the golf ball has a specific gravity of not less than 0.50 and less than 1.00, and a deformation amount (D) of 3.1 to 5.0 mm when applying from an initial load of 98 N to a final load of 1275 N, a ratio (F/D) of the flexural modulus of the cover (F) to the deformation amount of the golf ball (D) is within the range of more than 50 and not more than 125, and the core has a deformation amount of 4.1 to 5.5 mm when applying from an initial load of 98 N to a final load of 1275 N.

2. The golf ball according to claim 1, wherein the ratio (F/D) is within the range of 55 to 120.

3. The golf ball according to claim 1, wherein the deformation amount (D) is within the range of 3.4 to 4.0 mm.

4. The golf ball according to claim 1, wherein the cover has a flexural modulus (F) of 300 to 400 Mpa.

5. The golf ball according to claim 1, wherein the deformation amount (D) is within the range of 3.3 to 4.5 mm.

6. The golf ball according to claim 1, wherein the ratio (F/D) is within the range of 65 to 110.

7. The golf ball according to claim 1, wherein the ratio (F/D) is within the range to 80 to 95.

8. The golf ball according to claim 1, wherein the specific gravity is 0.80 to 0.99.

9. The golf ball according to claim 1, wherein the specific gravity is 0.90 to 0.98.

* * * * *